United States Patent [19]

White

[11] Patent Number: 4,573,497

[45] Date of Patent: Mar. 4, 1986

[54] REFRIGERANT REVERSING VALVE

[75] Inventor: Lee A. White, Marysville, Ohio

[73] Assignee: Ranco Incorporated, Dublin, Ohio

[21] Appl. No.: 643,475

[22] Filed: Aug. 23, 1984

[51] Int. Cl.[4] ..... F16K 31/122

[52] U.S. Cl. ..... 137/625.29; 62/324.1; 62/324.6

[58] Field of Search ..... 62/324.1, 324.6; 137/625.29

[56] References Cited

U.S. PATENT DOCUMENTS

| | | | |
|---|---|---|---|
| 3,293,880 | 12/1966 | Greenawalt | 62/324 |
| 3,538,576 | 11/1972 | Saving | 137/375 X |
| 4,027,700 | 6/1977 | Perkins | 137/625.66 |
| 4,237,933 | 12/1980 | Bauer | 137/625.63 |
| 4,240,469 | 12/1980 | Bauer | 137/625.66 |
| 4,245,670 | 1/1981 | Bauer et al. | 137/625.29 |
| 4,255,939 | 3/1981 | Ou | 62/324.2 |
| 4,290,453 | 9/1981 | Bauer | 137/625.43 |
| 4,324,273 | 4/1982 | Bauer et al. | 137/625.29 X |

*Primary Examiner*—Lloyd L. King

*Attorney, Agent, or Firm*—Watts, Hoffmann, Fisher & Heinke

[57] ABSTRACT

A refrigerant flow reversing valve includes a tubular valve body defining ports for respectively communicating with the discharge of a refrigerant compressor, the compressor inlet and with heat exchangers in the refrigeration system. A valving member is supported by the body for movement with respect to the ports so that in one valving member position refrigerant flows through the heat exchangers in one direction and in a second valve member position refrigerant flows in the opposite direction through the heat exchangers. Refrigerant flow tubes are hermetically fixed to the reversing valve body for directing refrigerant flows through the valve from the refrigeration system. Heat transfer is blocked immediately adjacent the valve body for minimizing heat flow between the valve body and refrigerant in the flow tubes adjacent the valve body.

19 Claims, 9 Drawing Figures

REFRIGERANT REVERSING VALVE

DESCRIPTION

1. Technical Field

The present invention relates to flow reversing valves and more particularly relates to valves employed for reversing the direction of refrigerant flow in refrigeration systems.

2. Background Art

Reversible cycle compressor-condenser-evaporator refrigeration systems, such as "heat pumps", have typically employed valves, called "reversing" or "change over" valves, to reverse the direction of system refrigerant flow. Heat pump systems include a refrigerant compressor, an indoor heat exchanger, an outdoor heat exchanger, a refrigerant expansion device and the reversing valve. When refrigerant flows in one direction through the system the indoor heat exchanger functions as the refrigerant condenser for heating the space. When the refrigerant flow direction is reversed, the indoor heat exchanger functions as the refrigerant evaporator and cools the space.

Refrigerant reversing valves are two position four-way valves having first and second ports communicating with the refrigerant compressor inlet and discharge, respectively, and third and fourth ports defining opposite ends of the refrigerant circuit extending through the heat exchangers and the expansion device. In one reversing valve position, the compressor discharge is communicated to the third valve port and the compressor inlet is communicated to the fourth valve port so refrigerant flows from the third port through the heat exchangers and expansion device into the fourth port. In the other reversing valve position refrigerant flows through the heat exchangers and expansion device in the opposite direction from the fourth valve port to the third valve port.

High temperature, high pressure refrigerant discharged from the compressor flows through a "discharge line", including the reversing valve, to the refrigerant condensing heat exchanger. Low temperature, low pressure refrigerant exiting the refrigerant evaporating heat exchanger flows through a "suction line", including the reversing valve, to the compressor inlet. Compressor discharge refrigerant which is resident in the refrigerant condensing heat exchanger is at a high temperature compared to atmospheric temperature and contains a substantial amount of heat which should be transferred from the system to assure optimum efficiency. The refrigerant exiting the refrigerant evaporating heat exchanger and moving to the compressor inlet is at a relatively low temperature since the refrigerant evaporator absorbs heat from its surroundings.

It has been recognized that heat pump refrigeration systems are less efficient than systems in which refrigerant flow is not reversed. Reversing valves have been empirically identified as responsible for efficiency losses. Such losses have been quantified by operating a given system with and without a reversing valve under the same operating conditions.

When heat pump systems are operated to heat internal spaces during cold weather the temperature of the indoor heat exchangers has tended to be relatively cool because the low outside air temperatures have reduced the amount of heat gained by refrigerant in the outdoor heat exchangers. This resulted in the necessity to supplement indoor air heating by employing electric resistance heaters, etc., particularly when atmospheric temperatures are quite low. Losses of system efficiency due to reversing valve losses have further tended to depress the indoor heat exchanger heat content and require operation of resistance heating elements more than would otherwise be necessary.

Efficiency losses due to reversing valves have generally been attributed to internal valve leakage, refrigerant pressure drops across the valve, and heat losses including heat transfer between the refrigerant streams in the valve and heat transfer between the reversing valve and atmosphere (radiation, conduction and convection). These losses have been perceived as of significance primarily when systems operate in their heating mode, since heat lost from the discharge refrigerant was not available for heating. Nevertheless, the particular nature of the losses attributable to reversing valves in refrigeration systems has received little attention and performance losses attributable to respective identified kinds of losses have not been quantified. One reason why these modes of efficiency loss have not been individually quantified is that the symptons of each type of loss are the same or serve to mask the existence of another type of loss. For example, a value construction which seems to produce a relatively small pressure drop may in fact be subject to substantial internal leakage which is manifested in part by relatively higher pressure downstream from the valve.

Reversing valve designs have thus reflected concerns about the kinds of losses referred to by concentrating on the provision of valves which exhibit reduced internal leakage rates, reduced refrigerant pressure drops across the valve and reduced heat losses. U.S. Pat. No. 3,032,312, for example, represents a design improvement calculated to reduce heat transfer between the discharge and the suction line refrigerant streams within the valve by providing a valve slide member having internal dead spaces to impede heat flux through the valve.

Refrigeration system heat exchangers and flow pipes are typically constructed from copper, which has a high heat conductivity so that heat is readily transferred to or from the system refrigerant, as appropriate. The reversing valves have been connected to the system pipes by hermetic, brazed joints and have thus employed component parts compatible with the system materials and well adapted for brazing. Typical reversing valves have been constructed using brass valve bodies and valve seats with copper refrigerant flow tubes projecting from the valve bodies to enable brazing the valve assembly to the refrigeration system pipes.

Reversing valve manufacturing processes have enabled the valve seats, valve body and flow tubes to be fixtured and brazed together in brazing furnaces. These processes have permitted use of material for the valve body construction which is not highly compatible for brazing to the flow tubes and seats. For example, stainless steel has been proposed as a valve body material because stainless steel is cheaper and stronger than brass and because welding can be employed to join body components together. Even though stainless steel is not a desirable material with which to form the brazed joints the controlled conditions available during valve assembly manufacture have permitted the materials to be so formed together.

Fully assembled reversing valves used for repair or replacement parts are installed in heat pump systems in situ by workmen using brazing materials and torches to heat and bond the valve flow tubes to the refrigerant system pipes. The reversing valve assemblies include internal seals and other components formed from plastic or rubber-like materials which have sometimes been damaged by overheating during installation in heat pump systems. The reason was that heat from the brazing process was conducted to the valve assemblies via the flow tubes. If the brazing process was not adequately controlled the heat flux damaged temperature sensitive valve components. To reduce the possibility of damage the valve assemblies are frequently wrapped with wet cloths.

Original heat pump unit manufacturers typically braze copper extension pipes to the reversing valve assemblies before installing the assemblies into the heat pump units. The extension pipes are brazed to the reversing valve assemblies in specially constructed, chilled fixtures so that the valve assemblies are not excessively heated. When the valve assemblies, with the extension pipes attached, are brazed to the heat pump unit itself the length of the extension pipes are sufficiently great to isolate the valve assembly from the brazing heat.

Typical prior art reversing valves of the sort generally disclosed by U.S. Pat. No. 3,032,312 (and others) have employed brass valve bodies, plastic or dual walled valving members shiftable in the body to effect valving of the refrigerant flows, a ported brass bearing seat along which the valving member slid, and copper refrigerant flow directing tubes hermetically bonded to the reversing valve and to refrigerant flow pipes of the suction and discharge lines.

Research leading to the invention has recently been conducted to determine the actual refrigerant pressure drops across such a valve, the degree of refrigerant leakage within the valves and the valve heat losses. The research has demonstrated that significant heat losses occur from the high temperature refrigerant stream to the low temperature stream. These losses have been discovered to be significantly greater than the losses due to radiation, convection and conduction from the valve to atmosphere and, most unexpectedly, do not occur primarily within the valve itself but closely adjacent the valve body in the refrigerant flow tubes.

Indeed, the newly discovered heat losses are greater than either the pressure drop losses or the refrigerant leakage losses encountered in a properly sized valve constructed in accordance with the design disclosed by U.S. Pat. No. 3,032,312 referred to previously.

By instrumenting prior art type reversing valves, temperature distributions over the valve body and the refrigerant discharge and inlet tubes revealed that significant heat from the high temperature refrigerant flowing through the valve is transferred to the discharge line refrigerant via the flow tubes at locations closely adjacent the valve body. Heat is then conducted through the valve body and the valve seat to the refrigerant suction line flow tubes. Heat in those tubes is then transferred back to the low temperature suction line refrigerant adjacent the valve body.

Temperature differentials exceeding 100° F. have been observed between valve body locations near the junctures with the discharge refrigerant flow tubes and valve body locations adjacent the suction line flow tubes. These gradients exist between relatively closely spaced locations separated by relatively large area heat paths.

A significant amount of heat from the high pressure, high temperature refrigerant discharged from the compressor is transferred into the low temperature, low pressure refrigerant entering the compressor via conductive heat flow paths through and immediately adjacent the reversing valve. Heat from the high temperature refrigerant is irreversibly lost to the low pressure refrigerant flowing to the compressor inlet and cannot be recovered to affect heating of the conditioned space.

As noted previously the reversing valve suction and discharge flow tubes have typically been constructed from copper with the tubes having a relatively heavy wall thickness to assure adequate strength. Temperature differentials exceeding 50° F. have been observed along these tubes over the first few inches proceeding away from the valve body. Beyond that distance the tube wall and refrigerant temperatures equalized, indicating that minimal heat was transferred between them. These observations signified that a surprisingly large and hitherto unsuspected amount of heat transfer occurred between the flow tube walls and the refrigerant through an extremely short tube length adjacent the valve body.

DISCLOSURE OF THE INVENTION

The present invention provides a new and improved refrigerant reversing valve so constructed and arranged that heat transfer via the valve components to low temperature low pressure system refrigerant is substantially blocked.

In accordance with one preferred embodiment of the invention a refrigerant reversing valve is provided having a valve body defining refrigerant suction and discharge body ports, a valving member supported by the body for movement to reverse the direction of refrigerant flow through selected ports, refrigerant flow directing tubes communicating with the ports and hermetically fixed to the body, and heat transfer blocking structure for minimizing heat transfer between high and low temperature refrigerant streams via conduction through the valve components and flow tubes.

The heat transfer blocking structure provides an extremely high impedance conductive heat transfer path through and along the valve flow tubes which greatly impedes heat transfer between the refrigerant and the flow tube walls. In one preferred embodiment of the invention the suction line flow tubes include at least a tube section immediately adjacent the valve body constructed from high strength material having a low coefficient of heat conduction compared to copper. The tube section walls are quite thin yet are adequately strong so that the low coefficient of conductive heat transfer and the small cross-sectional area of the tube section combine to offer a high degree of resistance to heat conduction along the tube section from the valve body. The flow tube section extends at least several inches away from the body.

The valve flow tubes can be constructed entirely from stainless steel, carbon steel, or other materials which impede conductive heat transfer between the tube and the refrigerant. The flow tubes can be provided with a thin sheathing of copper or other suitable material to facilitate brazing the valve assembly to the refrigeration system pipe. The sheathing material is preferably plated onto the flow tubes and has a cross-sectional area so small that no material amount of heat conduction occurs along the sheathing.

Another alternative construction employs a carbon steel or stainless steel flow tube section joined to the valve assembly and having a cuff-like end section bonded to the flow tube remote from the valve body. The cuff is formed from copper or other material which is adapted to be joined to the refrigeration system pipes by brazing.

Flow tubes which strongly resist heat conduction, such as those referred to, also serve to protect internal components of reversing valves against damage from overheating while the valve is brazed to the system pipes during its installation in the system.

Another important feature of the invention resides in the use of a valving member seat constructed from material having a relatively low conductive heat transfer coefficient and configured to provide maximally long, small area conductive heat flow paths between refrigerant flow ports to impede heat conduction. In the preferred reversing valve construction the seat is constructed from sintered iron which exhibits low friction characteristics with the valve slide while strongly resisting conductive heat transfer between the high and low temperature refrigerant streams.

Reversing valve assemblies constructed according to the invention have been observed to create such marked and surprising improvements in reversing valve performance that significantly smaller, less costly reversing valve assemblies embodying the invention can be employed without reductions in system performance characteristics.

Other features and advantages of the invention will become apparent from the following detailed description of preferred embodiments made with reference to the accompanying drawings which form part of the specification.

BEST MODE FOR CARRYING OUT THE INVENTION

Figure 1:
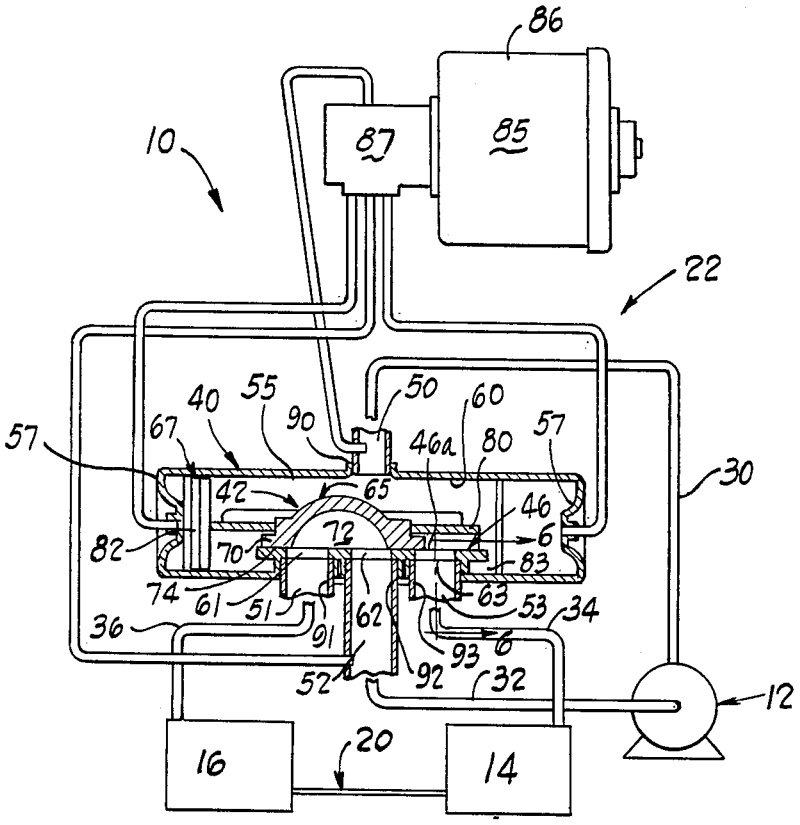
FIG. 1 is a schematic view of a heat pump refrigeration unit constructed according to the present invention.

A heat pump system 10 constructed in accordance with the present invention is illustrated by FIG. 1 of the drawings as comprising a refrigerant compressor 12, an outdoor heat exchanger 14, an indoor heat exchanger 16, a refrigerant expansion device 20 connected between the indoor and outdoor heat exchangers, and a refrigerant reversing valve assembly 22 for reversing the direction of refrigerant flow through the indoor and outdoor heat exchangers when desired.

The compressor 12 is a suitable or conventional electric motor driven refrigerant compressor and is therefore not disclosed in detail. High temperature high pressure refrigerant is delivered from the compressor discharge port to the reversing valve assembly 22 through a discharge pipe 30. Low temperature low pressure refrigerant returning to the intake of the compressor from the heat exchangers flows to the compressor intake from the reversing valve assembly 22 through a suction pipe 32.

The heat exchangers 14, 16 and the expansion device 20 may be of any suitable construction and are therefore not illustrated or described in detail.

The reversing valve assembly 22 is a two-position flow reversing valve which, in its condition illustrated by FIG. 1, directs the refrigerant flow in the heat pump system 10 so that the heat pump system operates in a "cooling" mode for cooling indoor air. In its cooling mode condition the valve assembly 22 directs high pressure high temperature refrigerant through a discharge line extending from the compressor discharge through the pipe 30, the valve assembly 22 and a system flow pipe 34 to the outdoor heat exchanger 14 where heat is transferred away from the refrigerant and the refrigerant condenses to its liquid phase. The refrigerant then flows through the expansion device 20 after which the refrigerant is returned to its vapor phase in the indoor heat exchanger 16. As the refrigerant passes through the indoor heat exchanger, heat from the space being conditioned is transferred to the refrigerant resulting in cooling the air in the space. Low temperature low pressure refrigerant flows out of the indoor heat exchanger to the compressor inlet through a refrigerant suction line including a flow pipe 36, the reversing valve assembly 22, and the pipe 32 to complete the refrigeration cycle.

In its second condition the reversing valve assembly 22 reverses the flow of the refrigerant through the indoor and outdoor heat exchangers to cause the heat pump system 10 to operate in its "heating mode". When the reversing valve is in its heating mode condition, high pressure, high temperature refrigerant from the compressor discharge is directed through a discharge line including the reversing valve into the indoor heat exchanger where the refrigerant is condensed resulting in the transfer of heat into the space being conditioned. The condensed refrigerant then passes through the expansion device and evaporates again in the outdoor heat exchanger. Heat from the atmospheric air or other ambient medium is absorbed by the refrigerant in the outdoor heat exchanger after which the low pressure low temperature refrigerant is returned to the compressor inlet via a suction line through the reversing valve assembly.

In the illustrated and preferred embodiment of the invention the reversing valve assembly comprises a tubular valve body 40 containing a valving assembly 42 coacting with a ported valve seat 46, and refrigerant flow tubes 50–53 which are hermetically joined to the valve body 40 for communicating refrigerant flows to the valve body interior.

The valve body 40 is comprised of a cylindrical tubular body member 55 the ends of which are closed by end caps 57 hermetically welded, or otherwise joined, to the body member. The body member defines a smooth cylindrical inner wall surface 60 which is slidably engaged by the valving assembly.

The valve seat 46 is fixed in the valve body and defines seat ports 61–63 which coact with the valving assembly 42 to control the flow of refrigerant in the system 10. The seat 46 defines a smooth, low friction bearing support face 46*a* through which the seat ports 61–63 open.

The valving assembly 42 slides relative to the seat 46 between a cooling mode position in which the ports 61, 62 are in communication and a heating mode position in which the ports 62, 63 are in communication.

The valving assembly 42 comprises a valve slide 65, and a valve slide actuator 67. The valve slide is formed by a body 70 defining a smoothly contoured flow directing cavity 72 opening into a flat bearing face 74 which sealingly engages the valve seat face 46*a*. The flow directing cavity 72 has a width dimension corresponding to the diameters of the seat ports 61–63 and a length dimension such that the port 62 is communicated either with the port 61 or the port 63 via the cavity 72 depending upon the condition of the reversing valve.

The slide 65 is shifted between its alternate positions by the actuator 67 which, in the preferred embodiment, includes a slide bracket 80 engaging the slide and pistons 82, 83 at opposite ends of the bracket for applying actuating forces to the slide. The pistons sealingly engage the surrounding valve body wall surface 60 and in the illustrated embodiment include skirt-like plastic piston rings or cups to maintain a relatively low friction contact line of sealing engagement between the pistons and the valve body.

The valving assembly position is controlled by a pilot valve 85. In the illustrated system the pilot valve includes a solenoid 86 for controlling a pilot valve assembly 87. The pilot valve assembly 87 communicates with the high and low pressure sides of the refrigeration system as well as with the opposite ends of the valve body 40 via capillary tubes and the end caps 57. When the solenoid is energized, the pilot valve communicates high pressure refrigerant to one end of the valve body 40 and low pressure refrigerant to the other end of the valve body resulting in the actuator 67 shifting the valve slide to the position illustrated by FIG. 1 of the drawings. When the pilot valve solenoid is deenergized the pilot valve reverses the application of refrigerant pressures on the actuator 67 and the slide is forced in the opposite direction to its position in which the ports 62, 63 are communicated via the valve slide cavity.

The refrigerant flow tubes 50–53 enable communication of the reversing valve assembly 22 to the refrigeration system. The valve body 40 defines body ports 90–93 which respectively receive the flow tubes 50–53. The flow tube 50 is hermetically joined to the valve body 40 about the port 90 for communicating the interior of the valve body with the compressor discharge pipe 30. For this reason the tube 50 is referred to as the discharge tube. The flow tubes 51–53 extend into the valve body ports 91–93 and are hermetically joined to both the valve body 40 and the valve seat 46. The flow tubes 51–53 communicate with the respective seat ports 61–63. The flow tube 52 communicates with the compressor suction inlet via the pipe 32 and is therefore referred to as the suction tube. The flow tube 51 communicates with the indoor heat exchanger while the flow tube 53 communicates with the outdoor heat exchanger. Either the tube 51 or the tube 53 is in communication with the suction tube 52, depending upon the condition of the valving assembly 42.

The reversing valve assembly 22, to the extent generally described thus far, is essentially the same as prior art reversing valves. The prior art valves generally employed valve bodies and valve seats constructed from brass and flow tubes formed of copper. The brass bodies and seats provided excellent machinability and were quite compatible with the flow tube materials so that brazing the valve ports together during manufacturing was easily and reliably accomplished.

As indicated previously, refrigerant reversing valves have been generally linked to heat pump system performance losses. Research conducted on prior art type reversing valves has disclosed losses due to heat flux between high temperature and low temperature refrigerant streams passing through the valves to be unexpectedly great and that these unexpected losses have occurred at locations and by mechanisms which were not previously recognized.

Figure 2:
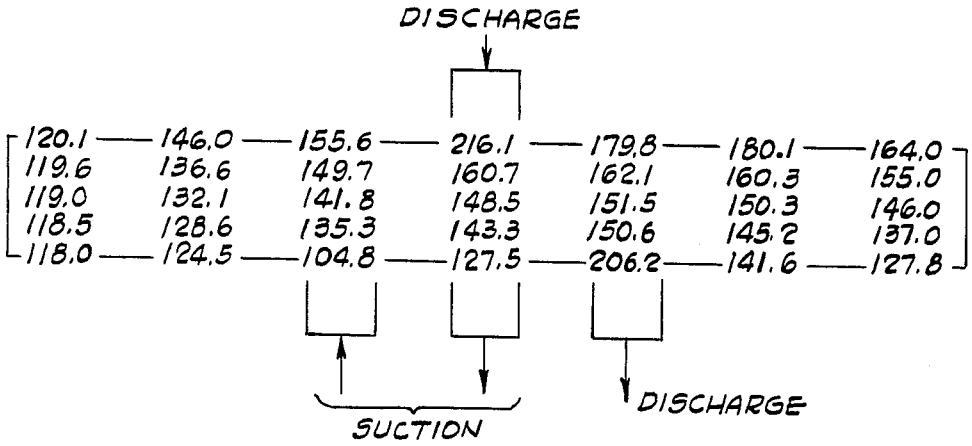
FIGS. 2, 3 and 4 graphically depict the results of research conducted on prior art reversing valves of the sort used in heat pump systems.

The research included, among other things, instrumenting a prior art valve assembly to determine temperatue distributions over its surfaces. FIG. 2 of the drawings illustrates the temperatures (Fahrenheit) at various locations on the exterior surface of a conventional brass valve body during operation of a heat pump system in its cooling mode.

As should be expected the valve body surface temperature near its juncture with the discharge tube is the highest observed surface temperature while the surface temperature observed near the juncture with the flow tube returning refrigerant from the indoor heat exchanger is the lowest. It is notable that the temperature differential between a surface location near the juncture with the suction tube and a location near the juncture with the discharge line flow tube leading to the outdoor heat exchanger is nearly 80° F. The brass material forming the valve body had a coefficient of thermal conductivity of about 60 BTU/hr.ft.F. so that the heat flux through the body between these relatively closely spaced locations was not considered to be sizable.

Figure 3:
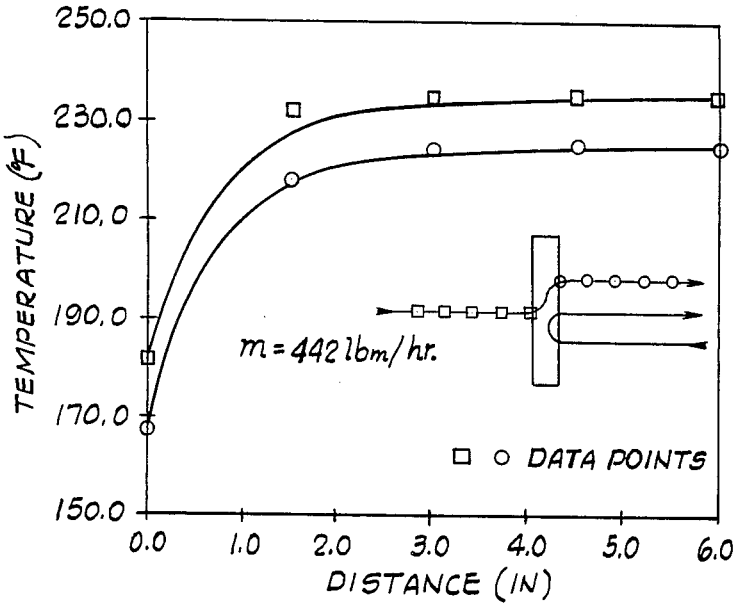
Figure 4:
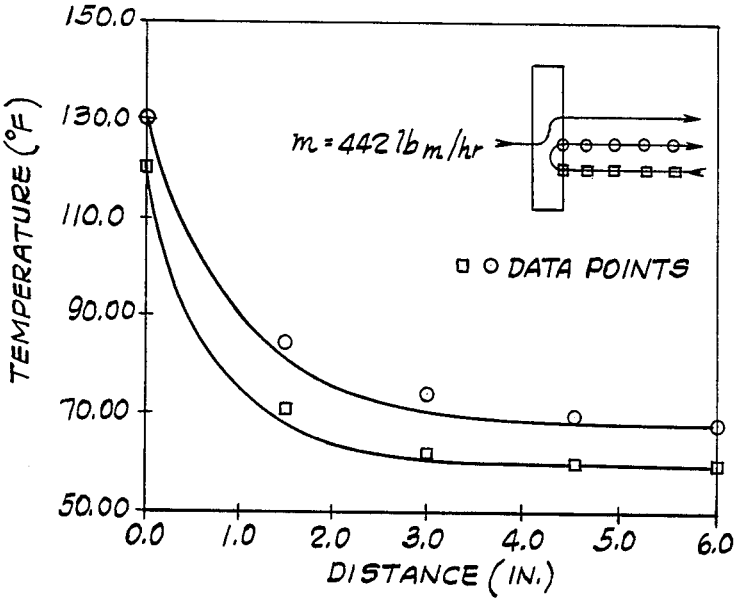
Figure 5:
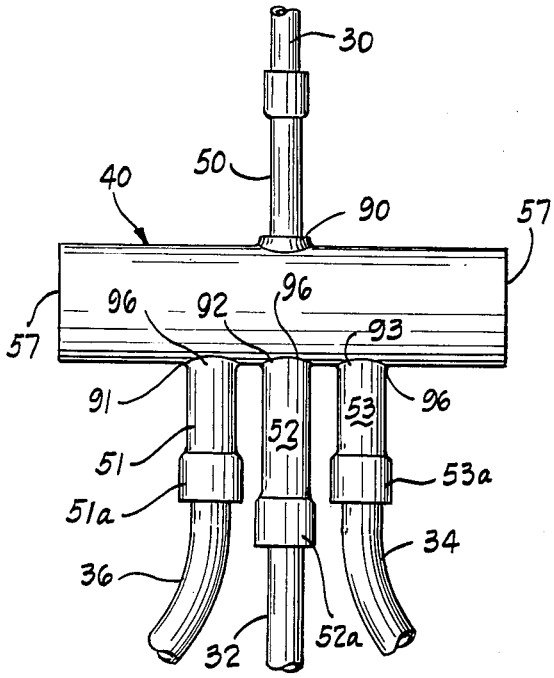
FIG. 5 is an elevational view of a refrigerant reversing valve assembly, having parts removed, connected to refrigerant pipes of a heat pump system.

FIGS. 3 and 4 of the drawings graphically represent temperatures observed on the surfaces of the copper flow tubes at spaced locations proceeding away from their junctures with the valve body as a heat pump system was operated in its cooling mode. FIG. 3 represents temperature distributions along the discharge line flow tubes while FIG. 4 represents temperature distributions along the suction line of flow tubes.

These temperatures distributions evidence a surprisingly great and hitherto unsuspected heat flux between the flow tubes immediately adjacent the valve body and the refrigerant passing through them. These Figures illustrate that the flow tube surface temperature stabilizes substantially at the refrigerant temperature proceeding away from the the valve body beyond a distance of about 4½ inches. The temperature differential along the longitudinal extent of the flow tubes from the valve body is between 50° F. and 60° F. with most of the differential occurring over an inch or so of the tubes immediately adjacent the valve body.

The heat flux evidenced by the temperature gradient along the suction line flow tubes (see FIG. 4) proceeding away from their junctures with the valve body is quite significant. This is because the flow tubes are copper, the tube walls are relatively thick (about 0.032 inches to afford adequate bursting strength) so that the tubes provide a relatively large heat conducting cross-sectional area (e.g. about 0.05 sq. in. for a ½ inch diameter tube), and the temperature differential along the first inch or so of tube proceeding from the valve body is 50° F. Since the coefficient of conductive heat transfer of copper is extremely high (about 224 BTU/hr.ft.F.), the heat flux through the flow tubes to the refrigerant adjacent the valve body is quite significant and, in fact, virtually dwarfs the remaining forms of heat losses from the discharge refrigerant attributable to the prior art reversing valves.

FIG. 3 makes it plain that at least part of the heat flowing to the suction line refrigerant via the suction flow tubes is transferred from the discharge line refrigerant to the discharge flow tubes, through the valve body and the seat and to the suction flow tubes.

These reversing valve heat losses are actually realized by heat flux to the suction line refrigerant flowing in the suction flow tubes closely adjacent the valve body. The heat losses referred to are particularly troublesome during operation of the heat pump system in its heating mode since the heat transferred to the suction line refrigerant would otherwise be available in the indoor heat exchanger for heating the space. Moreover, the heat transferred to the suction line refrigerant serves to increase its temperature and pressure thus reducing the volumetric efficiency of the compressor.

The loss of heat from the indoor heat exchanger during heating directly results in reducing the temperature of indoor air and contributes to the necessity of using auxiliary heaters when the heating load is high.

When the heat pump unit is operating in its cooling mode the loss of heat from the high pressure, high temperature discharge refrigerant, of itself, is not particularly undesirable; but the heat gain by the suction line refrigerant flowing to the compressor intake again adversely affects the volumetric efficiency of the compressor.

According to the present invention a new and improved refrigerant flow reversing valve is provided in which heat flux to the suction line refrigerant via the suction line flow tubes is substantially blocked, thus significantly improving the reversing valve effectiveness. Valves fabricated with heat transfer blocking constructions according to the invention have demonstrated markedly improved performance compared to prior art valves, particularly in heat pump refrigeration systems operating in their heating modes, due to the significant reductions in heat losses from the compressor discharge line refrigerant to the suction line refrigerant.

A reversing valve constructed according to the invention and as illustrated by FIGS. 1 and 4–6 of the drawings provides for refrigerant flow tubes constructed and arranged to block heat transfer to the suction line refrigerant adjacent the valve body and a valve seat construction for impeding heat transfer between the closely spaced discharge line and suction line ports formed in the seat.

In the preferred and illustrated valve, sections of the flow tubes 51–53 are constructed and arranged to block heat transfer to the suction line refrigerant. The preferred flow tubes are formed from relatively thin wall and high strength material having a low coefficient of heat conduction compared to that of copper. Type 304 stainless steel has proved to be a suitable material, however carbon steel could also be used. Each tube is hermetically joined to the valve body 40 and to the seat 46 by brazing which is accomplished during production of the valve assembly by fixturing the ports together with flux and brazing alloy between them and moving the assemblage through a brazing furnace. The inwardly projecting flow tube ends **51*b*–53*b* are smoothly tapered to a reduced diameter and project through the respective valve body port into engagement with internal seat port shoulders 61*a*–63*a*. The brazed joints (indicated by the reference character 94 FIG. 6) between the tubes and seat are formed between the tube exteriors and the seat ports adjacent the shoulders. The brazed joints 96 between the valve body 40** and the flow tubes are formed along the exterior wall of the valve body at the respective valve body ports.

The outwardly projecting ends of the flow tubes are configured to form bells **51*a*–53*a* for joining to the refrigerant lines of the system. In the illustrated valve the tubes 51–53 are copper plated to better facilitate brazing the respective bells 51*a*–53*a*** to the refrigeration system pipes. The copper plating is so thin that it has no effect on heat conduction along or through the flow tube walls.

The coefficient of thermal conductivity of the stainless steel flow tube material is about 8 BTU/hr.ft.F. (compared to 224 BTU/hr.ft.F. for copper tubes) and the wall thickness of the structurally strong stainless steel tubes is only about $\frac{2}{5}$ that of the prior art copper tubes (i.e. about 0.020 inches). Because the stainless steel tube wall thickness is small the cross-sectional heat flow area of the flow tubes is substantially less than that of prior art copper tubes which results in further flow tube heat conduction impedance.

Were carbon steel tubes to be used, the conductive heat transfer coefficient is about 25 BTU/hr.ft.F. which is about 10% of the value for copper. Thus carbon steel flow tubes will function to substantially block heat flux through the suction line flow tubes.

The preferred and illustrated embodiment of the invention also employs a low heat conductivity flow tube 50 between the valve body 40 and the compressor discharge pipe 30. The use of a heat flux blocking tube for directing discharge line refrigerant to the reversing valve further impedes the transfer of heat to the valve body from which it could be lost from the system by conduction, convection and radiation as well as being transferred to the suction line refrigerant.

The preferred refrigerant flow reversing valve also incorporates an improved low heat conduction valve seat construction. As indicated previously, prior art reversing valves were constructed using brass seats which were machined from solid brass stock to provide a low friction bearing face for the valve slide, and a semi-cylindrical base mating with the inner wall of the valve body. It has been discovered that the brass seats created a significant heat flux path to the suction line refrigerant via the flow tubes. This was due to the fact that the heat flux path through the seat was quite short and defined a substantial cross-sectional area.

Figure 6:
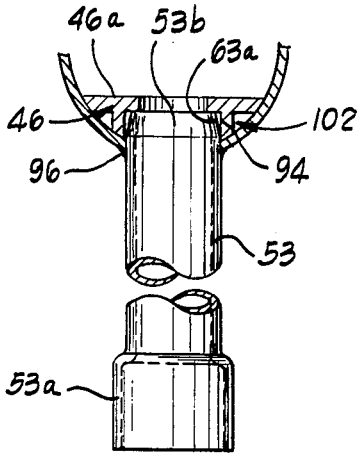
FIG. 6 is a cross-sectional view seen approximately from the plane indicated by the line 4—4 of FIG. 1 with parts removed and broken away.
Figure 7:
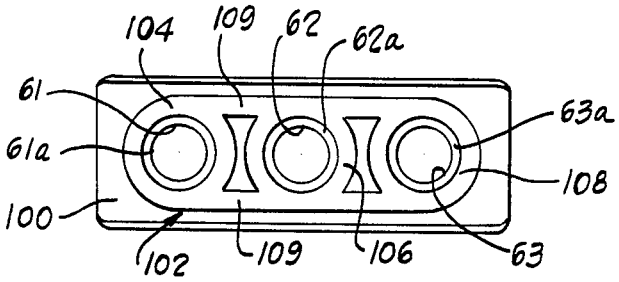
FIG. 7 is a view seen from the plane indicated by the line 7—7 of FIG. 6 and shown with parts removed for clarity.

The new seat 46 is constructed from material which resists heat conduction, and is configured to provide for maximum length heat flux paths having minimum cross-sectional areas. Referring to FIGS. 6 and 7 the new seat has a generally rectangular plate-like bearing section 100 and an integral valve body engaging land 102. The land 102 forms relatively thin walled tube engaging sleeves 104, 106, 108 in which the flow tube ends are brazed. The land 102 provides web sections 109 between the sleeves to stiffen the construction yet define a small contact area with the valve body to impede heat conduction between the body and the seat. The relatively thin walls of the tube sleeves and webs also provide restricted cross-sectional areas for heat flux conduction while requiring heat to flow through the sleeves and the bearing section 100 in order to reach the suction line refrigerant interface. The new seat is preferably constructed from sintered cast iron which has a coefficient of thermal conductivity of no more than about 35 BTU/hr.ft.F. Thus the heat conductivity of the new seat material itself, combined with the seat configuration providing for low area, relatively long heat conduction paths, substantially reduces heat transfer to the suction line refrigerant via the seat.

In the illustrated embodiment of the invention the valve body 40 is formed from stainless steel. The stainless steel valve body provides relatively high resistance heat flow paths between the junctures of the valve body and the suction and discharge lines. However, because the valve body of necessity defines relatively large cross-sectional areas and short paths for heat flux to the suction line refrigerant flows, the use of a stainless steel valve body instead of a brass body does not, in and of itself, materially improve the valve performance.

Figure 8:
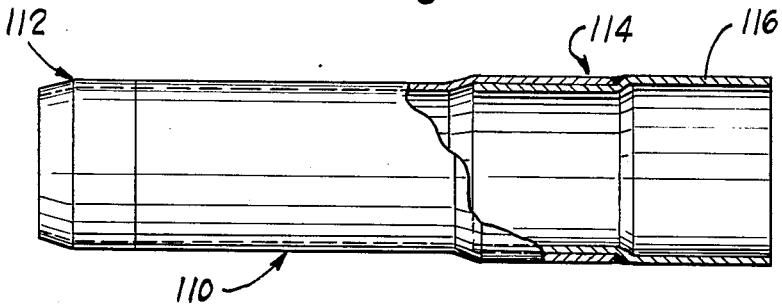
FIG. 8 is a cross-sectional view of an alternative reversing valve flow tube construction embodying the invention.

FIG. 8 illustrates an alternative refrigerant flow tube construction 110 which facilitates brazing the flow tube to its associated system refrigerant pipe. The flow tube 110 comprises a thin wall stainless steel tube having a spigot end 112 and a remote bell end 114. The bell end 114 carries a brazing cuff 116, formed of copper, which is hermetically bonded to the flow tube bell 114. In the preferred construction the brazing cuff is connected to the flow tube by a laser welded joint, but other welding or joining processes can be employed. The brazing cuff can also be formed from aluminum if desired, or some other metal which is suitable for brazing into the system refrigerant lines regardless of its heat conductive properties. It should be noted that the flow tube 110 is sufficiently long to block any material amount of heat conduction from the valve body to the brazing cuff or vice versa.

Figure 9:
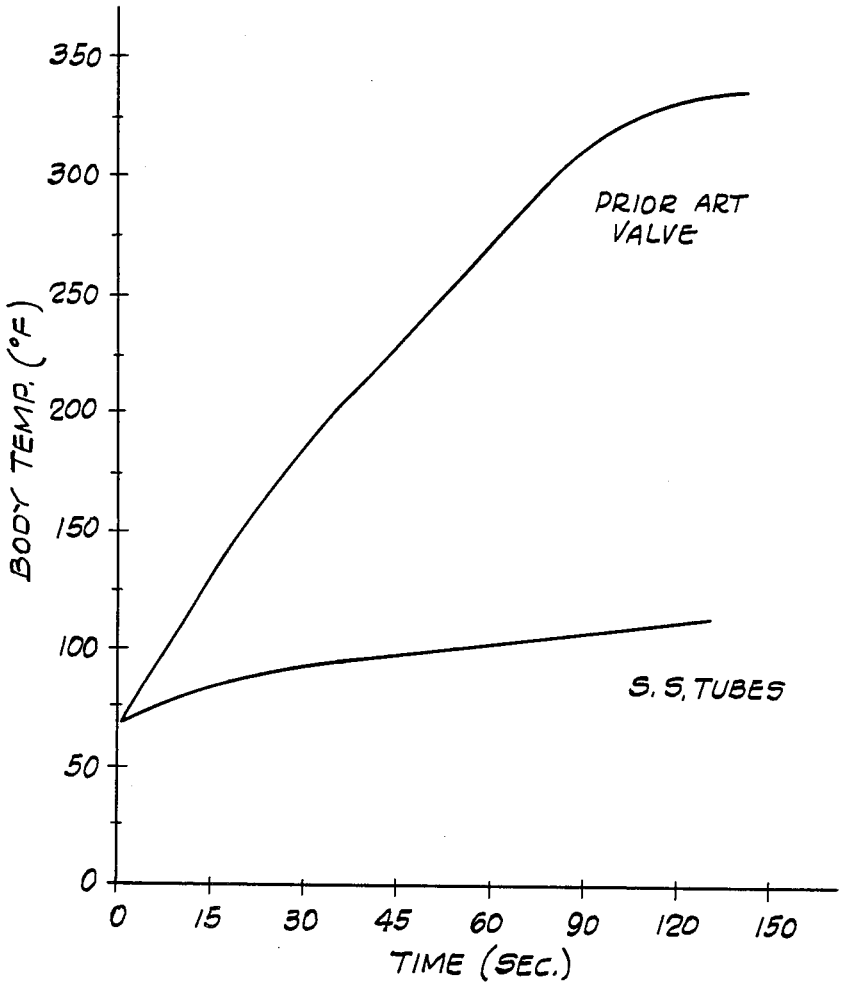
FIG. 9 is a graphic illustration of differences in heat transfer characteristics between a prior art valve and a valve constructed according to the present invention.

FIG. 9 graphically illustrates the difference in heat conductivity between a prior art reversing valve and a reversing valve constructed according to the invention. A prior art reversing valve (i.e. a reversing valve having a brass valve body, a brass valve seat and copper flow tubes) and a reversing valve constructed according to FIGS. 1 and 4–7 were each supported with the projecting ends of the suction line and discharge outlet flow tubes of each valve immersed in a solder pot maintained at about 600° F. The temperature change with respect to time at a given location on each valve body was monitored.

The monitored temperature on each valve body is plotted against time on FIG. 9 of the drawing. As illustrated, after two minutes the prior art reversing valve body temperature had increased from room temperature to nearly 350° F. while the body temperature of the reversing valve constructed according to the invention had risen to just over 100° F. FIG. 9 thus clearly demonstrates the heat flux blocking ability of the new valve construction. FIG. 9 also demonstrates the ability of the new valve to resist overtemperature damage to interior components which could otherwise occur during installation of the reversing valve if the flow tubes were exposed to heat from brazing torches for extended periods of time.

While a preferred embodiment of the invention has been disclosed in detail along with certain alternative constructions, the present invention is not to be considered limited to the precise constructions disclosed here. Various adaptations, modifications and uses of the invention may occur to those skilled in the art to which the invention relates and the intention is to cover all such adaptions, modifications and uses falling within the spirit or scope of the appended claims.

I claim:

1. A refrigerant flow reversing valve comprising:

(a) a tubular valve body defining a first port for communicating with the discharge of a refrigerant compressor, a second port for communicating with the compressor inlet and third and fourth ports for communicating with heat exchangers in the refrigeration system;

(b) a valving member supported by said body for movement with respect to said ports so that in a first position of said valving member refrigerant flows through said valve from said first port to said third port and from said fourth port to second port and in a second valve member position refrigerant flows from said first port through said fourth port and from said third port through said second port;

(c) refrigerant flow tubes hermetically fixed to said reversing valve body and respectively associated with said ports for directing refrigerant flows through said valve from the refrigeration system said flow directing tubes; and, (d) heat transfer blocking means immediately adjacent said valve body for minimizing heat flow between said valve body and refrigerant in the flow tubes associated with said second, third and fourth flow tubes adjacent said valve body.

2. A refrigerant flow reversing valve as claimed in claim 1 further including a valving member seat fixed in said body for supporting said valving member, said seat having a bearing face engaging said valving member and defining seat ports corresponding to and communicating with said second, third and fourth body ports, said heat transfer blocking means further comprising seat member sleeve elements immediately surrounding said body ports, and said flow tubes and engaging said body along relatively narrow annular areas to minimize heat conduction between the body ports through the seat member.

3. The refrigerant flow reversing valve claimed in claim 2 wherein said seat member is formed of a metallic material having a coefficient of heat conduction which is small compared to that of brass.

4. The refrigerant flow reversing valve claimed in claim 2 wherein the end regions of the flow tubes associated with said second, third and fourth body ports are formed from stainless steel and said seat member is formed from a ferrous material.

5. The refrigerant flow reversing valve claimed in claim 1 wherein the end regions of the flow tubes associated with said second, third and fourth body ports are formed from a metallic material having a coefficient of heat conduction of not more than about 30 BTU/hr.ft.F.

6. A refrigerant flow reversing valve for a mechanical refrigeration system comprising a tubular valve body containing a flow reversing valve member, refrigerant flow tubes hermetically attached to said valve body and extending from said valve body for directing refrigerant in discharge and suction lines of said system to and from said body, and heat transfer blocking means immediately adjacent said valve body for minimizing heat flux from said body to refrigerant in said suction lines via flow tubes for said suction line refrigerant.

7. The valve claimed in claim 6 wherein said heat transfer blocking means is formed at least in part by said suction line flow tubes which consist at least along part of the length thereof adjacent the valve body, of a material having a coefficient of thermal conductivity of no more than about 30 BTU/hr.ft.F.

8. The valve claimed in claim 7 wherein said suction line flow tubes are formed at least in part from thin walled ferrous material.

9. The valve claimed in claim 7 wherein said suction line flow tubes are formed from stainless steel.

10. The valve claimed in claim 7 wherein said suction line flow tubes each further includes a brazing cuff hermetically attached to the projecting end thereof, said brazing cuff formed from a metal having a substantially greater coefficient of heat conduction than the adjacent flow tube material.

11. The valve claimed in claim 6 wherein said heat transfer blocking means further includes a valve seat member in said body said valve seat member defining a plate-like bearing element and flow tube receiving sleeve elements projecting from said bearing element for engagement with said valve body in said flow tubes.

12. The valve claimed in claim 11 wherein said seat member is constructed from a ferrous material.

13. The valve claimed in claim 12 wherein said seat is constructed from sintered cast iron.

14. A refrigerant flow reversing valve for use in a refrigeration system having a refrigerant compressor and at least first and second heat exchangers, said valve comprising:

(a) a valve body defining a first port communicating with the discharge of the refrigerant compressor, a second port communicating with the compressor inlet and third and fourth ports communicating with the heat exchangers;

(b) a valving member supported by said body for movement with respect to said ports so that in a first position of said valving member high pressure, high temperature refrigerant flows through said valve from said first port to said third port while low temperature, low pressure refrigerant flows from said fourth port said to second port and in a second valve member position high pressure, high temperature refrigerant flows from said first port through said fourth port while low pressure, low temperature refrigerant flows from said third port through said second port;

(c) refrigerant flow tubes hermetically attached to said body for directing refrigerant flows through said valve from the refrigeration system; and, (d) heat transfer blocking means for interupting the flow path of heat between said valve body and refrigerant at refrigerant flow passage locations adjacent said valve body.

15. The refrigerant flow reversing valve claimed in claim 14 wherein said heat transfer blocking means comprises sections of said flow directing tubes adjoining said valve body, said flow tube sections comprised of a ferrous metal having a low coefficient of thermal conductivity compared to copper.

16. The refrigerant flow reversing valve claimed in claim 14 wherein said heat transfer blocking means further includes a bearing seat for said valving member, said seat defining seat ports communicating with said second, third and fourth body ports, and with said bearing seat composed at least in part by material having a coefficient of heat conduction of no more than about 30 BTU/hr.ft.F.

17. A method of operating a reverse cycle refrigeration system having a compressor, first and second heat exchangers through which refrigerant flows from a compressor discharge line to a compressor suction line and a refrigerant flow reversing valve having a valve body communicating with the compressor intake and discharge lines and lines connected to the heat exchangers via refrigerant flow tubes comprising the steps of:

(a) directing high temperature high pressure refrigerant from the compressor discharge through the reversing valve to one heat exchanger via first and second flow tubes connected to the valve body;

(b) directing low temperature, low pressure refrigerant from the other heat exchanger to the compressor intake through the reversing valve via third and fourth flow tubes connected to the valve body; and, (c) blocking heat transfer from the third and fourth flow tubes to the refrigerant flowing therein in the vicinity of the junctures of said third and fourth flow tubes and said valve body to minimize conductive heat flow from the valve via the third and fourth flow tubes.

18. The method claimed in claim 14 further including blocking heat transfer from the refrigerant to the first and second flow tubes in the vicinity of the junctures of said first and second flow tubes and said valve body to minimize conductive heat flow to the valve via the first and second flow tubes.

19. In a mechanical refrigeration system comprising a refrigerant compressor, a refrigerant condensing heat exchanger, a refrigerant evaporating heat exchanger, a refrigerant expansion device between the heat exchangers and refrigerant discharge and suction lines for communicating the compressor discharge and inlet, respectively, with the heat exchangers, a refrigerant flow reversing valve connected in the discharge and suction lines for reversing the direction of refrigerant flow through the heat exchangers said reversing valve comprising:

(a) a valve body;

(b) a valving member supported for movement in said valve body;

(c) first and second refrigerant flow tubes hermetically joined to said valve body for directing discharge line refrigerant through said valve body;

(d) third and fourth refrigerant flow tubes hermetically joined to said valve body for directing suction line refrigerant through said valve body; and (e) heat transfer blocking means for substantially impeding heat flux into the suction line refrigerant via said third and fourth flow tubes immediately adjacent said valve body.

* * * * *